US005382462A

United States Patent [19]

Pacione

[11] Patent Number: 5,382,462

[45] Date of Patent: Jan. 17, 1995

[54] CARPET TAPE

[75] Inventor: Joseph R. Pacione, Thornhill, Canada

[73] Assignee: Tac-Fast Systems SA, Switzerland

[21] Appl. No.: 102,994

[22] Filed: Jul. 28, 1993

[51] Int. Cl.[6] ..... B32B 3/10; B32B 7/12

[52] U.S. Cl. ..... 428/95; 428/86; 428/100; 428/40; 428/343; 428/906

[58] Field of Search ..... 428/85, 86, 95, 100, 428/343, 352, 354, 40, 906

[56] References Cited

U.S. PATENT DOCUMENTS

| | | | |
|---|---|---|---|
| 2,717,437 | 9/1955 | Mestral | 28/72 |
| 3,009,235 | 11/1961 | Mestral | 28/78 |
| 3,353,663 | 11/1967 | Kayser et al. | 206/59 |
| 3,550,223 | 12/1970 | Erb | 24/204 |
| 3,583,057 | 6/1971 | Kolozsvary | 29/270 |
| 3,660,191 | 5/1972 | Shimota et al. | 156/152 |
| 3,711,349 | 1/1973 | Snyder et al. | 156/157 |
| 3,817,015 | 6/1974 | Frangos | 52/511 |
| 3,858,269 | 1/1975 | Sutton et al. | 16/16 |
| 3,863,412 | 2/1975 | Bodycomb et al. | 52/483 |
| 3,943,981 | 3/1976 | DeBrabander | 139/391 |
| 4,012,544 | 3/1977 | Richards | 428/95 |
| 4,114,346 | 9/1978 | Kelly | 52/746 |
| 4,149,540 | 4/1979 | Hasslinger | 128/327 |
| 4,405,668 | 9/1983 | Wald | 428/40 |
| 4,557,774 | 12/1985 | Hoopengardner | 156/71 |
| 4,581,269 | 4/1986 | Tilman | 428/62 |
| 4,581,274 | 4/1986 | Johns et al. | 428/95 |
| 4,671,976 | 6/1987 | Vidal | 428/40 |
| 4,716,065 | 12/1987 | McLaughlin | 428/95 |
| 4,755,401 | 7/1988 | Friedrich et al. | 428/17 |
| 4,758,457 | 7/1988 | Altus | 428/82 |
| 4,792,473 | 12/1988 | Vitale | 428/343 X |
| 4,810,546 | 3/1989 | McLaughlin | 428/62 |
| 4,822,658 | 4/1989 | Pacione | 428/95 |
| 4,829,627 | 5/1989 | Altus et al. | 428/95 X |
| 4,921,742 | 5/1990 | Altus | 428/95 X |
| 4,974,384 | 12/1990 | Pacione | 52/483 |
| 5,191,692 | 3/1993 | Pacione | 29/423 |
| 5,246,775 | 9/1993 | Loscuito | 428/343 |
| 5,254,384 | 10/1993 | Gordon | 428/95 X |

FOREIGN PATENT DOCUMENTS

| | | |
|---|---|---|
| 2201231 | 7/1973 | Germany . |
| 2803006 | 8/1979 | Germany . |
| 1204886 | 9/1970 | United Kingdom . |
| 1376262 | 12/1974 | United Kingdom . |
| 1546901 | 5/1979 | United Kingdom . |
| 267519 | 8/1970 | U.S.S.R. . |
| 86/03164 | 6/1986 | WIPO . |

OTHER PUBLICATIONS

Popular Science Magazine, p. 113, Aug. 1964.
Mad Magazine, p. 40, May, 1984.

*Primary Examiner*—Daniel R. Zirker
*Attorney, Agent, or Firm*—Brian W. Gray; John C. Hunt

[57] ABSTRACT

A carpet tape is disclosed with hooks projecting from the front side of a sheet for attachment to loops on the underside of the carpet and with an opposite adhesive side for attachment to the floor. Selected, non-contiguous areas of the sheet are removed to create holes to reduce the mount of material, to reduce seam telegraphing and to allow moisture to be released from beneath the tape. A covering provides integrity for the tape prior to installation.

5 Claims, 3 Drawing Sheets

CARPET TAPE

FIELD OF THE INVENTION

This invention relates to carpet tape to be used with a carpet construction which uses a loop back and a hook tape for installation.

BACKGROUND OF THE INVENTION

In U.S. Pat. 4,822,658 entitled "Carpet Backing and Installation System" issued Apr. 18, 1989, the same inventor disclosed a new carpet backing and installation system. The disclosure of that patent is hereby incorporated by reference. This new carpet with its backing has proved to be commercially successful. Installation of carpet using tape as described with this system saves considerable time and energy. Further, once the tape has been installed, worn or damaged carpet can be easily replaced by removal of the carpet and by the installation of new carpet over the installed tape. The tape, once installed can be reused many times, and it is at this stage that significant economies can be achieved.

In U.S. Pat. 4,822,658 a tape is disclosed having hooks and a covering over the hooks to prevent premature attachment of the hooks onto loops contained on the bottom of a novel carpet backing. On the opposite side of the tape is a pressure sensitive adhesive for adhering the tape to the floor. A release paper is attached over the adhesive at the back of the tape to be removed prior to installation of the tape on the floor.

Owing to the expense of the tape disclosed in U.S. Pat. 4,822,658 and for ease of installation (particularly with respect to the removal of the tape covering) it was proposed to use that tape primarily along the edges and at the seams of the carpet and at a few selected intermediate locations.

This arrangement works fine in many installations. However, it has been found that in some carpets with low pile, such as some commercial carpets where the tape is placed only at the seams, there is a possibility of "telegraphing" so that the outline of the tape could communicate through the carpet at the seams or at other places where the tape has been placed to provide additional adherence to the floor.

In addition, because of the expense of the tape, it is difficult to justify laying the tape across the whole floor, with the result that the tape does not contact the entire installed carpet undersurface. If the carpet is fixed to the floor across its whole undersurface, less dimensional stability needs to be added to certain types of carpet with the subsequent decrease in costs of the carpet.

Further, when the tape is placed only at selected seams or other selected locations, it is advisable to have a release paper backing over the pressure sensitive adhesive to prevent the tape from attaching until it has been located to be under carpet seams or other desired locations.

Moreover, tape is conventionally made of polyethylene or polypropylene which can trap moisture between the tape and the floor and this can damage the adhesive over time. If tape as disclosed in U.S. Pat. 4,822,658 is laid along the entire floor, this problem can be increased.

SUMMARY OF THE INVENTION

The present invention attempts to improve on the construction of carpet tape and the delivery and installation of rolled tape by providing for a tape which has holes to reduce the amount of material and cost required for the tape, to reduce seam telegraphing, and to allow moisture to be released from beneath the tape and in another aspect of the invention to provide for a method of delivery and installation of rolled carpet tape onto a floor.

If the cost of carpet tape can be reduced, it facilitates laying the tape economically across the entire surface of the floor. The application of the tape across the entire surface of the floor allows the tape to be unrolled directly without a tape backing to prevent attachment of the tape prior to positioning of the tape since this tape is not required to be located precisely in relation to the seams or other areas of preferred attachment. The tape can, therefore, be manufactured, transported and delivered to a site rolled in such a way that the adhesive of the tape meets the covering of the hooks on the opposite face so that the tape can simply be unrolled for direct attachment to the floor and installed where needed. This further reduces the cost by eliminating the tape backing, and the installation step of removing the tape backing.

When the tape is on the whole floor, the carpet can be made of a lower dimensional stability as it will be attached generally along its whole undersurface by a tape, albeit with less hooks per square inch than in existing tapes. Further, if greater adhesion is desired at the seams, tape such as shown in U.S. Pat. 4,822,658 can be used at those locations.

Alternatively, the carpet can be made of the same dimensional stability but attachment along the whole surface provides for greater stability for high traffic areas or for greater design flexibility in placing and replacing pieces of carpet along the whole floor surface.

Thus, the invention in one aspect is a carpet tape comprising hook means projecting from the front side of a sheet for attachment to loop means on the underside of a carpet and adhesive means on the second opposite side of the sheet for attachment to the floor in which some of the material of the sheet has been removed by the selective removal of parts of the sheet in non-contiguous areas so as to create holes through the sheet while still maintaining enough material to maintain sheet stability.

In another aspect the invention comprises the carpet tape described above and in which the tape is provided with a solid covering adhering to the hooks to give added dimensional stability to the tape during transportation and installation and, when the tape is installed on the floor, to prevent premature engagement of the tape with an overlaying carpet.

In yet another aspect, the invention comprises a roll of carpet tape which comprises a first side of plastic hooks, a second side of pressure sensitive adhesive, and a covering for the plastic hooks in which the covering comprises on one surface a fibrous material facing the hooks releasably attached to the hooks and on an opposite surface a release sheet for releasable engagement with the adhesive when such tape is rolled with the adhesive facing outwardly and in which the peel strength of the surface facing the hooks is greater than the peel strength of the release sheet.

In another aspect the invention comprises a method of installing hooked tape of this invention by unrolling it onto the entire surface of the floor under the carpet.

BRIEF DESCRIPTION OF THE DRAWINGS

Certain embodiments of the invention are described by reference to the accompanying drawings wherein.

PREFERRED EMBODIMENT

Figure 2:
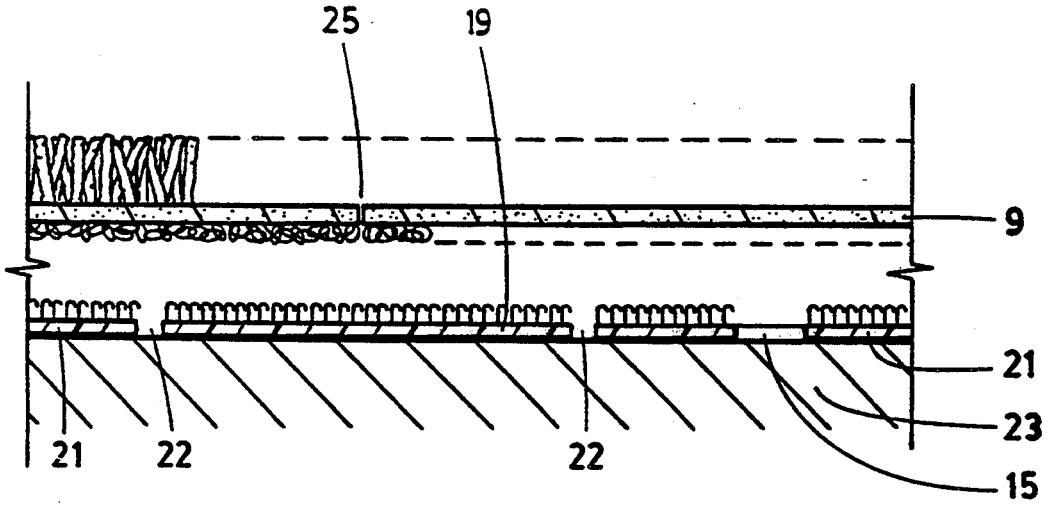
FIG. 2 is a partially exploded cross-section of a tape of this invention and a conventional tape attached to a floor and an overlaying carpet.
Figure 3:
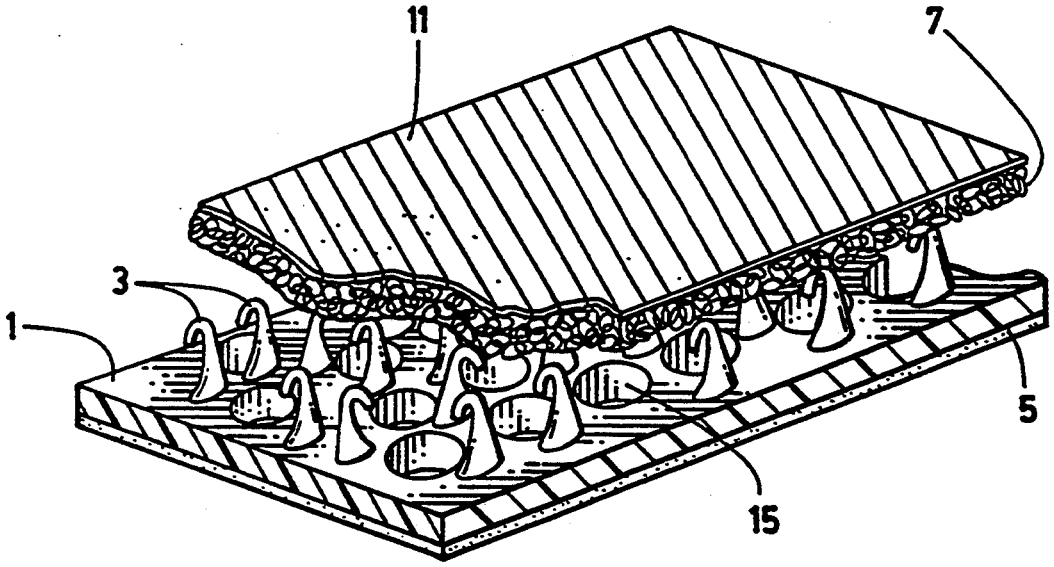
FIG. 3 is a tape in perspective view with a covering partially cut-away overlaying the tape.

Referring to the drawings, in particular FIG. 3, a tape has a tape body 1 having hooks 3. The tape body and hooks are generally made of polyethylene which has been injection moulded, continuously moulded or extruded. FIG. 3 does not show the hooks to scale since usually they will be much smaller and more numerous than as shown. Generally, such tape contains pressure sensitive adhesive 5 and covering 7. When the tape is fixed to the floor and carpet has been overlaid, the covering 7 prevents premature engagement of carpet 9 (shown in FIG. 2) to the tape so the carpet can be fitted and cut in place before it is attached to the tape.

Figure 4:
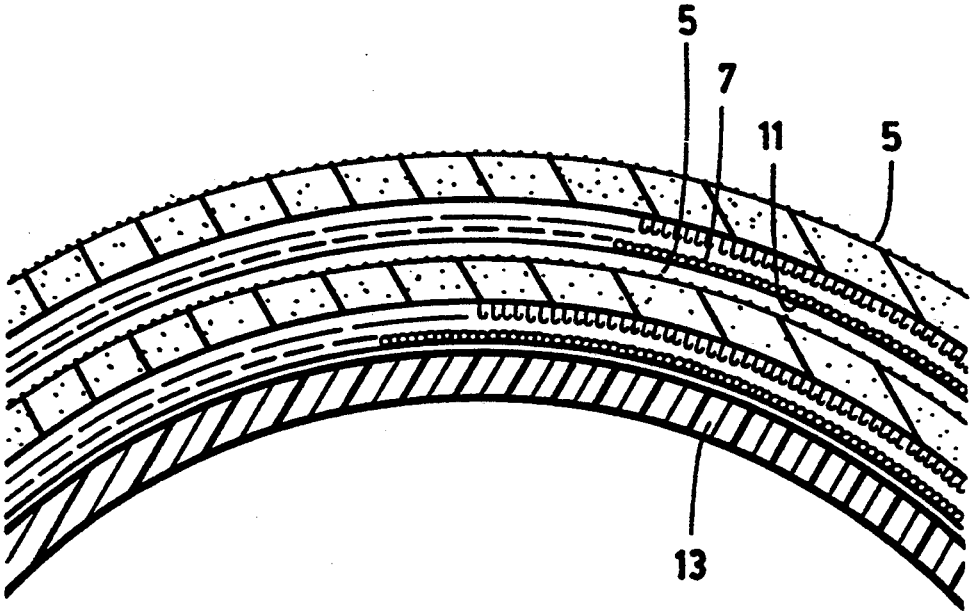
FIG. 4 is a cross-sectional view of a portion of the tape wound on a roll.

The covering 7 can contain a calendered or release surface 11 so that when the tape is rolled onto roll 13 as shown in FIG. 4 the adhesive side 5 is facing out. Such adhesive side 5 can meet calendered surface 11 of tape covering 7 so as to eliminate the need of a separate backing for the pressure sensitive tape, and consequently, also the need of the separate step of removing such backing before installation of the tape. The covering is thus made of cloth or paper so that one surface adheres to the hooks of the tape while the opposite surface is a release surface for the adhesive. The covering is designed so that the peel strength or adhesion of the cloth or paper surface to the hooks is higher than the adhesion of the release surface to the adhesive so that when the tape is unrolled the adhesive is exposed for attachment to the floor but the covering remains on the hooks.

Figure 1:
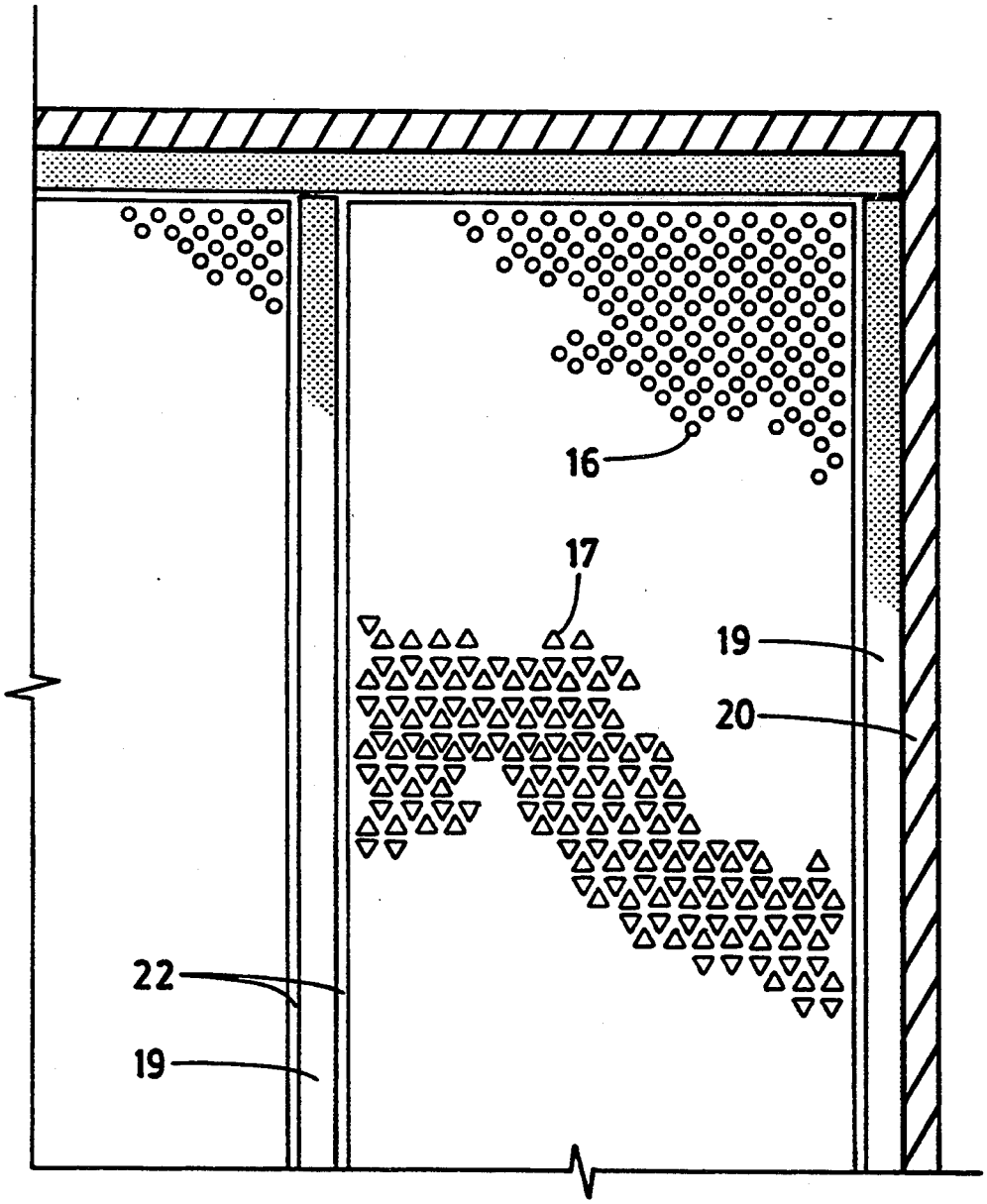
FIG. 1 shows tape installed onto a floor in which solid tape is installed along the edges and at the seams of the carpet (not shown) and "holed" tape of this invention is installed along other areas of the floor.

In the tape shown in FIG. 3 selected areas of the tape body have been removed so as to create holes 15. The tape in this embodiment resembles Swiss cheese in plan view. FIG. 1 shows a solid tape 19 laid along the perimeter of a room next to the walls 20 and at the seams. A "holed" tape can have a geometric pattern of holes 16 but any pattern of holes such as triangles as shown at 17 in FIG. 1 would also be acceptable. Indeed the pattern could be random since there is no set requirement that the holes be of any particular shape or size or dimension. It is important that most of the holes not be contiguous so as to maintain the integrity and the stability of the tape. Also, it is preferable that the holes be evenly distributed across the area of the sheet so that the tape has substantially equivalent holding power over a defined area. The tape holding capability and dimensional stability of solid tape is far greater than is normally needed for carpet installations. The tape installed on the floor will retain dimensional stability when adhered to the floor. If covered with a covering which does not have holes or apertures to prevent premature engagement of the carpet, the covering will give added dimensional stability so that when rolled as shown in FIG. 4 for transportation, storage and installation, it will have more than enough strength to be applied to the floor even when a substantial part of the material of the sheet has been removed in the manner shown. Further, if the tape is applied across the whole floor (and the whole undersurface of the carpet), then the holding power required of each area of the tape can be less, particularly in the area away from the edges of the carpet.

It is estimated that up to 70% of the material of the sheet could theoretically be removed and still maintain some tape stability, particularly with the covering and when the tape is rolled and transported as shown in FIG. 4. However, about 50% material removal is a preferred maximum amount while still maintaining adequate stability and providing sufficient holes to minimize trapped moisture. Since the polyethylene material is removed during manufacture prior to the coating of the pressure sensitive adhesive onto the back of the tape, the removed "virgin" polyethylene can be recycled by returning it to a vat or other processor. In some cases, where the tape is injection or continuous moulded, the holes may be incorporated into the shape of the moulds reducing or eliminating the need for subsequent punching or cutting and recycling of removed material. Material removal can substantially reduce the amount of polyethylene required and therefore, the cost of the tape. In addition, less surface requires less adhesive on the back of the tape further reducing the cost. It may now become more economical to apply the tape to the whole of the floor.

It is anticipated that "holed" tape of this invention could be provided in widths from 4 inches to up to 5 feet with one to two feet being preferred. Since it is believed that approximately 50% of the cost of the tape is polyethylene, (or other material such as polypropylene) and 50% the adhesive, if 50% of the polyethylene is removed (and thus 50% of the adhesive) the tape might be reduced in price by as much as 50%. Since greater volumes would be achieved if tape is used on the entire undersurface of the carpet, greater cost reductions due to volume could be anticipated.

Applying the tape to the whole of the floor means that there are less significant ridge lines as could be the case with the tape applied only at the seams or ends of the carpet. Although there are a series of holes or apertures in the tape, these apertures do not define a clear line, and it is these lines which are more easily "telegraphed" through a carpet, not patterns of holes.

It is considered that holes of ¼ inches to 2 inches would be normal with ½ inch preferred. Smaller holes reduce the possibility of telegraphing and also may provide for the removal of more material without damaging tape dimensional stability.

If more adhesion is required at the seams or edges, solid tape 19 can be used as shown in FIG. 1. In FIG. 2, solid tape 19 is also shown along with tape having holes 15. In FIG. 2, the tape 21 of this invention is attached to a floor 23. Carpet 9 has a seam 25. The solid tape 19 has been positioned to be under the seam 25 so as to provide greater holding at that seam. "Holed"tape 21 can be spaced from solid tape 19 by space 22. It is also possible to have a single tape which is both solid along one edge and "holed" elsewhere. Such tape could be aligned so that the solid portions meet underneath a seam.

As previously mentioned, there is an advantage to putting holes in the tape that communicate directly through the tape to the floor. Such holes can prevent a vapour lock so as to minimize the vapour barrier caused by the tape itself which could trap moisture between the tape and the floor. Such water vapour and moisture has been shown over time to damage the adhesive holding the tape to the floor. "Holed tape" could reduce the amount of vapour lock, and by giving the floor a chance to "breathe", help to minimize premature adhesive breakdown.

By providing for adhesion of the carpet to the floor along its whole undersurface, the dimensional stability of the carpet may be further reduced, as previously mentioned, providing an additional cost saving in carpet construction.

What is claimed is:

1. A plastic carpet tape for securing a wall-to-wall carpet having loop means on an underside thereof across an area of a floor, the tape comprising:

a sheet having hook means projecting from a first side for attachment to the loop means;

adhesive on a second opposite side of the sheet for attachment to the floor; and a solid covering for the hooks; and wherein, there are holes through the tape in non-contiguous areas thereof such that the tape relies on adherence to the floor for dimensional stability when installed; and the solid covering adds dimensional stability to the tape to permit installation of the tape and to prevent premature engagement of the hooks of an installed tape with the loops of an overlaid carpet.

2. The carpet tape of claim 1 in which the covering attaches to the hooks on a first side and contains a release layer on an opposite second side so that when the tape is rolled the adhesive on the backing contacts the release layer.

3. The carpet tape of claim 1 in which up to about 50% of the area of the sheet is removed and the holes are substantially uniformly distributed across the area of the sheet.

4. The carpet tape of claim 1 in which one edge of the sheet is solid tape of a width to receive an abutting seam of an overlaid carpet and the remainder of the sheet contains a plurality of holes through the sheet and distributed along its surface to provide for the release of water vapor trapped between the sheet and the floor.

5. The tape of claim 1 in which the tape is provided as a roll and the covering compresses on one surface a fibrous material facing the hooks releasably attached to the hooks and on an opposite surface a release sheet for releasable engagement with the adhesive when such tape is rolled with the adhesive facing outwardly and in which the peel strength of the surface facing the hooks is greater than the strength of the release sheet so that such covering remains on the hooks when the tape is unrolled.

* * * * *